United States Patent [19]

Renegar

[11] 4,263,348

[45] Apr. 21, 1981

[54] METHOD FOR STRIPING PENCILS

[75] Inventor: Charles G. Renegar, Shelbyville, Tenn.

[73] Assignee: Hasbro Industries, Inc., Pawtucket, R.I.

[21] Appl. No.: 62,032

[22] Filed: Jul. 30, 1979

Related U.S. Application Data

[62] Division of Ser. No. 780,370, Mar. 23, 1977.

[51] Int. Cl.[3] ..... B05D 5/00; B05C 3/02

[52] U.S. Cl. ..... 427/286; 118/404; 118/405; 118/411; 118/412

[58] Field of Search ..... 118/404, 405, 411, 412; 427/286

[56] References Cited

U.S. PATENT DOCUMENTS 2,880,698 4/1959 Olson ..... 118/405

FOREIGN PATENT DOCUMENTS 710069 9/1941 Fed. Rep. of Germany ..... 118/412

*Primary Examiner*—Michael R. Lusignan

*Attorney, Agent, or Firm*—Shapiro and Shapiro

[57] ABSTRACT

For striping pencils, paint is extruded through die orifices in the walls of a passage through which the pencil is advanced longitudinally. The orifices are formed in lands which engage corresponding side regions of the pencil and guide the pencil through the passage. The passage is formed in a block having parts that are supported for relative movement along guide rods and are urged together resiliently. Each block part may have at least one paint reservoir with a duct extending from the reservoir and terminating in a die orifice. The paint, which is supplied to the reservoirs under pressure from a separate source moves longitudinally of the pencil in shallow channels as it issues from the orifices and spreads laterally to an extent depending upon viscosity of the paint, forming stripes of width greater than that of the orifices.

7 Claims, 8 Drawing Figures

METHOD FOR STRIPING PENCILS

This is a division of application Ser. No. 780,370, filed Mar. 23, 1977.

BACKGROUND OF THE INVENTION

This invention is concerned with applying longitudinal stripes to pencils, particularly pencils of hexagonal cross-section.

Existing techniques for applying longitudinal paint stripes to the sides of pencils have several disadvantages. Striping by hand is time consuming, expensive and poorly adapted to mass production. Automated devices are complex, waste paint, and require frequent maintanence. For example, in devices of the type disclosed in German Pat. No. 710,069 (1941) and in Czechoslovakian Pat. No. 68,585 (1941) open-sided receptacles containing paint are provided, and the pencil is drawn along the open sides of the receptacles in contact with a pool of paint. Seals are required at the ends of the receptacle to prevent rapid loss of paint. In the well-known squeegee device, as disclosed in U.S. Pat. No. 2,331,983 to Kaiser, for example, paint is applied to all sides of the pencil and is wiped off of certain sides by wipers. The seals and wipers must be replaced as they wear. Disassembly and cleaning of the devices is not an easy matter.

In the wire manufacturing art various techniques are employed for applying stripes to insulated conductors. U.S. Pat. No. 2,880,698 to Olson discloses a striping device employing a passage having long channels of U-shaped cross-section that are filled with paint or other coating material from a suitable supply. The applicator is formed in two parts that are spring biased toward each other about a pivot and that mate to define the passage. U.S. Pat. No. 2,610,607 to Isenberg discloses a rotary striper in which reservoirs containing the striping material have spring biased followers to force the coating material through orifices in the wall of a bushing which is rotated about an insulated conductor. Such striping devices are not sufficiently simple, economical, precise and reliable for mass production striping of pencils.

BRIEF DESCRIPTION OF THE INVENTION

It is accordingly a principal object of the present invention to provide an improved device and method for striping pencils.

A further object of the invention is to provide a simpler striping device and method in which the stripes are precisely extruded from fixed die orifices and in which variations in pencil cross-dimensions are readily accommodated.

Another object of the invention is to provide a more versatile striping device for pencils that can easily be disassembled for cleaning and that maintains the precision of its operation with very little attention.

Briefly stated, from one of its aspects a pencil striping device in accordance with the invention comprises a block having a passage through which the pencil is moved longitudinally, the passage having lands engaging corresponding side regions of the pencil for guiding the movement of the pencil through the passage, and means for extruding striping material onto a side region of the pencil, the extruding means including a reservoir in the block for receiving pressurized striping material and a duct extending from the reservoir and terminating in an orifice in a land.

BRIEF DESCRIPTION OF THE DRAWINGS

The invention will be further described in conjunction with the accompanying drawings, which illustrate a preferred and exemplary embodiment of the invention and wherein.

DESCRIPTION OF THE PREFERRED EMBODIMENT

Figures 1, 1A, 6:
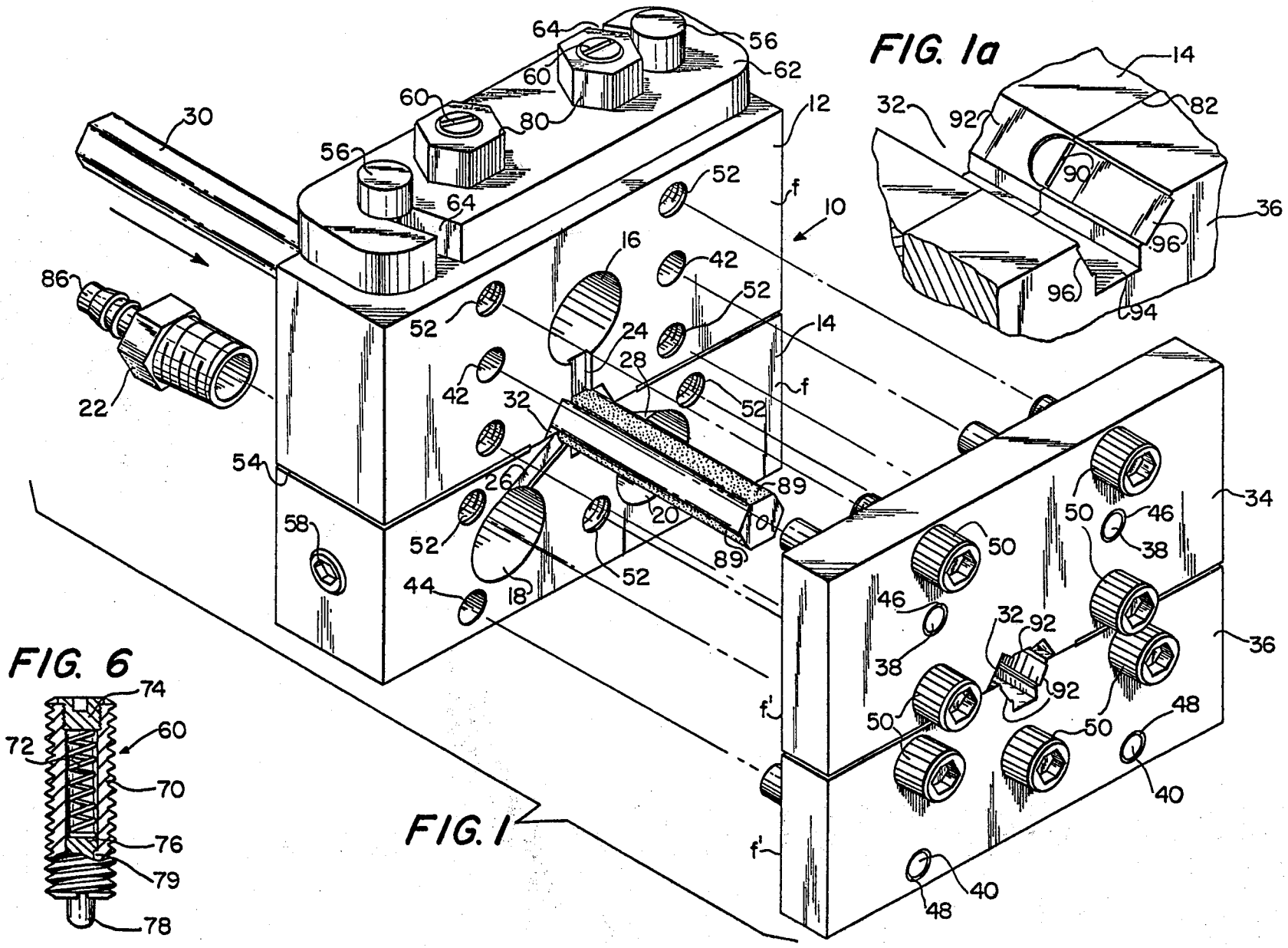
FIG. 1 is an exploded perspective view illustrating the manner in which the device of the invention applies stripes to three panels of a pencil of hexagonal cross-section.
FIG. 1*a* is a fragmentary enlarged perspective view illustrating a detail of the invention.
FIG. 6 is a sectional view illustrating a spring biasing element which may be employed in the invention.

As shown in FIG. 1, a striping device in accordance with a preferred embodiment of the invention comprises a block 10 having a pair of block parts 12 and 14, which may constitute upper and lower paint heads. The term "paint" as used herein is intended to include conventional striping materials, such as quick-drying nitrocellulose-base striping lacquers. In the illustrative form of the invention the upper paint head has a single reservoir 16 and the lower paint head has a pair of reservoirs 18 and 20 which receive paint via corresponding couplings 22 (only one of which is shown in FIG. 1) as will be described later. The reservoirs have associated ducts 24, 26, and 28 for delivering the paint to corresponding panels or sides of a pencil 30 which is advanced longitudinally through a passage 32 in block 10.

The block parts 12 and 14 are preferably rectangular parallelepipeds formed of material such as steel, for example, with the reservoirs and ducts occupying only a minor part of the volume of the block parts, so that the block parts are rigid and rather massive and are sturdy enough to retain their shape and dimensions in use. Ducts 24–28 are preferably formed as shallow rectangular grooves in a face f of block parts 12 and 14, which is manufactured, as by machining, to fit very tightly with an opposed face f' of cover plates 34 and 36, one cover plate being provided for each of the block parts 12 and 14. Passage 32 extends through the cover plates as well as the block parts, as shown. The cover plates are preferably constructed like the corresponding block parts, although thinner, and are precisely located relative to the corresponding block parts by means of dowels 38 and 40. The dowels, which may be steel pins, for example, are preferably press fitted into corresponding bores 42 and 44 of the block parts and slidably received in bores 46 and 48 of the cover plates with close tolerance.

The cover plates are removably attached to the corresponding block parts, as by screws 50 which pass through bores in the cover plates and are threaded into bores 52 in the block parts.

Figure 2A:
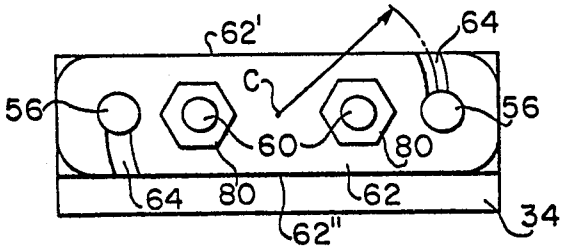
FIG. 2*a* is a top plan view of the device shown in FIG. 2.
Figure 2:
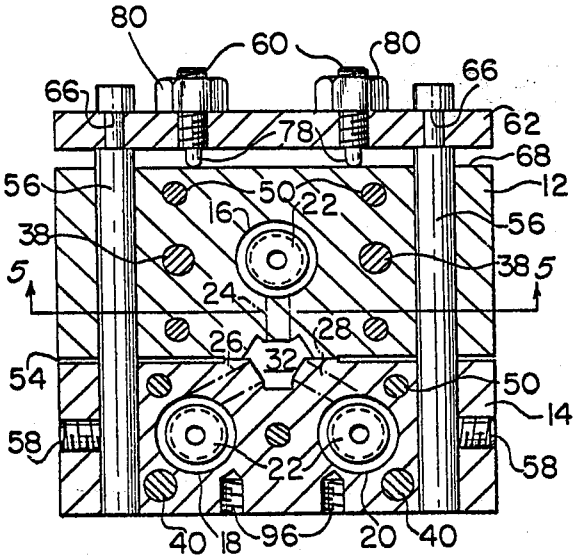
FIG. 2 is a sectional view taken along line 2—2 of FIG. 3, with the position of the ducts shown in phantom.

Block parts 12 and 14 and the corresponding cover plates 34 and 36 mate at a junction plane 54 which intersects passage 32 longitudinally. As shown in FIGS. 1 and 2, to provide a precisely defined junction between the block parts and the associated cover plates, surface contact between the block parts and cover plates mating at plane 54 may be limited to a relatively small area, such as the area adjacent to passage 32 at opposite sides of the passage, the remaining portions of the opposed surfaces at plane 54 being spaced slightly as shown. Alternatively, the surfaces mating at plane 54 may be in contact only at regions spaced from passage 32.

As shown in FIG. 2, parallel guide rods 56 extend through corresponding bores in block parts 12 and 14 at opposite sides of passage 32. The guide rods are preferably fixed to block part 14, as by means of set screws 58 threaded into corresponding bores in block part 14 and engaging the guide rods. Block part 12 is slidable upon the guide rods with close tolerance, to provide precisely controlled movement of block part 12 toward and away from block part 14.

Block parts 12 and 14 are resiliently biased toward one another. This is preferably accomplished by spring biasing elements 60 mounted on a plate 62 that is supported on projecting ends of the guide rods 56. As shown in FIGS. 1, 2, and *2a*, plate 62 has oppositely directed slots 64 by which the plate may be engaged with shoulders 66 on the projecting ends of the guide rods 56. By extending the slots 64 from opposite edges 62', 62" of plate 62 and by making the slots arcuate with the curvature centered about the center C of plate 62, plate 62 may be assembled with (or disassembled from) guide rods 56 by turning the plate about its center C and parallel to side surface 68 of block part 12, so that each guide rod shoulder enters (or leaves) the corresponding slot. The spring biasing elements 60 will then engage the adjacent surface 68 of block part 12, which is spaced from plate 62 as shown in FIG. 2.

The spring biasing elements are preferably spring plungers of the type manufactured by Carr Lane Manufacturing Co. of St. Louis, Missouri. As shown in FIG. 6, each biasing element comprises a threaded sleeve 70 containing a compression coil spring 72, one end of which engages a slotted head 74 threaded into the sleeve and the other end of which engages a reciprocating end piece 76 having an exposed rounded nose 78 projecting from sleeve 70. A stop 79 is provided to limit outward movement of the end piece from the sleeve. The biasing elements may be threaded into corresponding bores extending through plate 62, as shown in FIG. 2, and fixed in position relative to plate 62 by means of nuts 80 threaded onto the biasing devices. Noses 78 engage surface 68 of block part 12, and the biasing devices are threaded into plate 62 sufficiently to compress springs 72 somewhat, so that block part 12 is resiliently urged toward block part 14.

Figure 5:
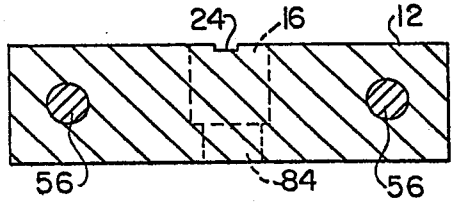
FIG. 5 is a sectional view taken along line 5—5 of FIG. 2.
Figure 3:
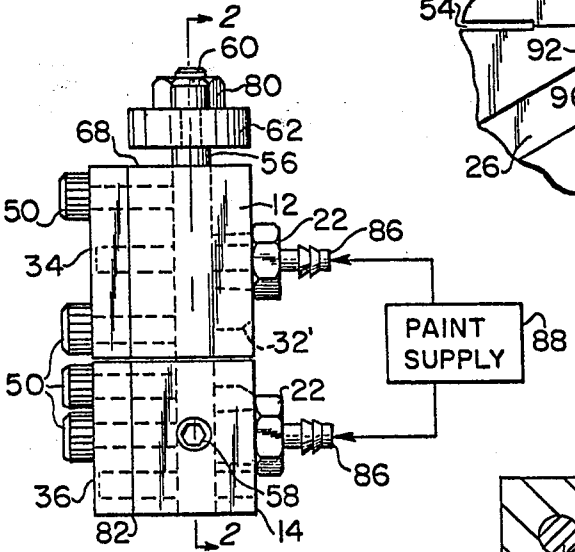
FIG. 3 is a side view of the striping device shown connected to a paint supply schematically.

As is apparent from the drawings, reservoirs 16, 18, and 20 are preferably cylindrical chambers with their axes parallel to the length of passage 32 and with one side open at the face f of block parts 12 and 14. The plane at which the cover plates are juxtaposed with the block parts is designated by reference numeral 82 in FIG. 3. As stated earlier, cover plates 34 and 36 have a very close fit with the block parts. This prevents paint from escaping from the open side of the reservoirs as well as the open side of the corresponding ducts. No auxiliary seals are required. At the opposite side of reservoirs 16–20, threaded bores are provided, as shown at 84 in FIG. 5, for receiving the coupling devices 22. The coupling devices may have barbs 86 that are inserted into the ends of flexible hoses (not shown) for coupling the reservoirs to a suitable paint supply 88, as indicated in FIG. 3, which supplies paint to the reservoirs at a suitable pressure, such as about 20 psi.

Figure 4:
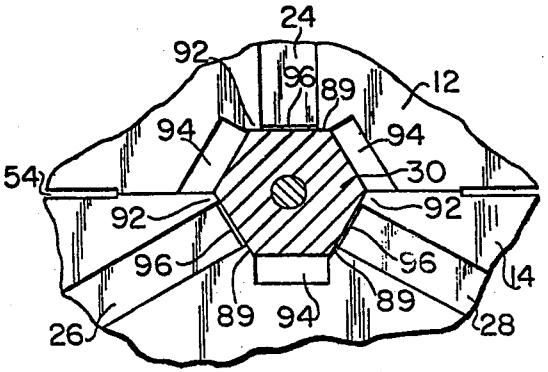
FIG. 4 is an enlarged fragmentary elevation view illustrating the relationship between a pencil and the associated parts of the device for applying strips to three panels of a pencil.

In the illustrative form of the invention, three symmetrically disposed panels 89 of a pencil 30 of hexagonal cross-section are striped. For this purpose, the three ducts 24, 26, and 28 terminate in die orifices 90 formed in corresponding lands 92 which define walls of passage 32. See FIG. 1*a*. To guide the pencil through passage 32 and yet to minimize friction as the pencil moves through the striping device, the sides of the pencil are engaged only by the lands, and the passage 32 is enlarged between the lands, as shown by the spaces 94 in FIG. 4, to avoid contact between the passage walls and the pencil at these regions. Each orifice 90 is preferably a tiny rectangular slit, with its longer cross-dimension transverse to the direction of movement of the pencil 30 through passage 32 and with its shorter cross-dimension very small relative to the corresponding dimension of the associated land 92 (orders of magnitude smaller). Each land 92 is milled out or otherwise cut away to provide a shallow channel 96 preferably extending across approximately the full thickness of the corresponding cover plates 34 and 36. If the channels are formed by milling after the cover plates and block parts are assembled, they may incidentally extend into the block parts 12 and 14, as in the semi-circular configuration shown in FIG. 1*a*. The shallow channels, typically 0.125 inch wide and 0.005 inch deep, permit the paint extruded from the tiny die orifices 90 to move longitudinally with the panels to be coated as the pencil is advanced through the striping device.

In the use of the device of the invention, pencils 30 to be striped are fed into and through passage 32 as indicated by the arrow in FIG. 1. For ease of operation, the entry and exit of passage 32 may be tapered somewhat, as shown at 32' in FIG. 3, in which event channels 96 will terminate short of the tapered exit. Individual pencils may be fed seriatim through the striping device in any conventional manner, or a continuous length of pencil, supplied from a pencil extruding machine, for example, may be fed through the striping device and later cut into individual pencils. In either event the pencils may have been painted uniformly before striping, to provide a base coat of paint of one color. Pressurized paint of another color is supplied from paint supply 88 to the reservoirs 16–20. As the pencils are advanced, the paint is forced from the reservoirs through the corresponding ducts 24–28 transversely to the pencil and then through die orifices 90 and onto the pencil panels 89 to be striped.

The paint flows in ducts 24–28 as thin layers of rectangular cross-section flowing perpendicular to the pencil 30. As the paint issues from the die orifices it immediately engages the pencil and changes direction by 90 degrees to flow as thin layers in the channels 96 as the pencil is moved longitudinally through passage 32. The thickness of these layers (e.g., about 0.005 inch, the depth of channels 96) is about the same as the thickness of the paint stripes as formed, but the stripes may shrink slightly in drying. The width of the stripes is greater than the corresponding cross-dimension of orifices 90 and is also greater than the width of channels 96, since the paint spreads laterally beyond the ends of the orifices as it leaves the orifices and spreads further laterally as it leaves the channels.

In a typical embodiment of the invention, the reservoirs 16–20 are ½ inch in diameter and ½ inch deep. The ducts 24–28 are 0.120 inch wide and 0.020 inch deep, forming rectangular orifices 90 of the same dimensions. With paint having a viscosity of 40–55 seconds when measured with a #4 Zahn cup, the paint will flow 0.015 inch (up to 0.018 inch) laterally beyond each end of the orifices to provide stripes that are 0.150 inch wide (the 0.120 inch width of the orifice plus 2×0.015 inch). This is just about the width of the side panel of a conventional pencil of hexagonal cross-sectional configuration.

The spring biasing elements 60 provide sufficient pressure, such as 1.3 to 2.0 pounds pressure per plunger, to maintain the paint heads (block parts 12 and 14) resiliently urged against the pencil at all times. The block parts will normally be separated by about 0.010 inch. If an oversized pencil is fed through the striping device, block part 12 can ride up on the guide rods 56 to maintain an even pressure on the pencil.

While a preferred embodiment of the invention has been shown and described, it will be apparent to those skilled in the art that changes can be made without departing from the principles of the invention. For example, for striping only a single pencil panel, block part 14 may be replaced by a block part having substantially the same outer configuration but lacking the reservoirs, ducts, etc. for supplying paint. Instead, the lands of the replacement block part would merely serve to guide the pencil through the striping device. These lands could be made of Teflon, for example, or the entire replacement block part could be so made, to reduce friction. Within the broader aspects of the invention, the striping device may be modified to provide pin stripes, corner stripes, or combinations of different types of stripes, which may cover entire panels, parts of panels, or corners of pencils or the like of polygonal cross-sectional configuration. The invention is very versatile, can be fitted to almost any standard roller drive paint machine (as by screws in threaded holes 96 shown in FIG. 2), and is easily cleaned after removal of the cover plates. Further disassembly simply requires removing plate 62 and then separating block part 12 from block part 14.

The invention claimed is:

1. A method of striping a pencil which comprises moving the pencil longitudinally through a passage in a striping block, said passage having a wall defining raised lands engaging circumferentially spaced side regions of the pencil, directing a stream of striping material onto one of said side regions through an orifice in one of said lands and causing said material to flow from said orifice longitudinally in the direction of movement of the pencil in a channel in said one land as a layer on said one side region having a thickness substantially equal to the thickness of a stripe being formed.

2. A method in accordance with claim 1, wherein said orifice has a smaller lateral dimension than said channel and said striping material spreads laterally in said channel beyond opposite ends of said orifice.

3. A method in accordance with claim 2, wherein said striping material spreads laterally beyond the width of said channel upon release therefrom.

4. A method in accordance with claim 2, wherein the directing and causing steps recited are replicated at spaced side regions about the periphery of the pencil.

5. A method in accordance with claim 2, wherein said striping material is supplied to said orifice from a reservoir in said block and is delivered to said orifice from said reservoir through a duct terminating in said orifice, the cross-dimensions of said duct being substantially the same as the cross-dimensions of said orifice.

6. A method in accordance with claim 2, wherein the striping material flows through said duct to said orifice as a thin layer of rectangular cross-section flowing transverse to said pencil, said layer engaging said pencil as it is forced through said orifice and then changing direction by about 90 degrees to flow along said pencil longitudinally.

7. A method of striping a pencil which comprises moving the pencil longitudinally through a passage in a striping block, directing a stream of striping material onto a side region of the pencil through an orifice in the wall of said passage with said striping material flowing through said orifice as a thin layer having a major dimension extending transversely to said pencil, said thin layer engaging said pencil as it flows through said orifice and then changing direction by about 90 degrees and flowing longitudinally in the direction of movement of the pencil in a channel in said wall of the passageway.

* * * * *